US005440680A

United States Patent [19]

Ichikawa et al.

[11] Patent Number: 5,440,680

[45] Date of Patent: Aug. 8, 1995

[54] IMAGE DISPLAY CONTROLLER HAVING A COMMON MEMORY FOR STORAGE OF IMAGE OVERLAY DATA AND WINDOW IDENTIFICATION DATA

[75] Inventors: Norihito Ichikawa; Masatoshi Imai, both of Tokyo; Hidehiro Hirase, Kanagawa; Shinji Takashima, Tokyo, all of Japan

[73] Assignee: Sony Corporation, Japan

[21] Appl. No.: 308,634

[22] Filed: Sep. 19, 1994

Related U.S. Application Data

[63] Continuation of Ser. No. 778,013, Oct. 17, 1991, abandoned.

[30] Foreign Application Priority Data

Oct. 23, 1990 [JP] Japan ..... 2-283405

[51] Int. Cl.[6] ..... G06F 3/14

[52] U.S. Cl. ..... 395/158; 395/157; 395/164

[58] Field of Search ..... 395/158, 157, 135, 164, 395/166; 345/120, 119, 114, 189, 191, 201

[56] References Cited

U.S. PATENT DOCUMENTS

| | | | |
|---|---|---|---|
| 4,559,533 | 12/1985 | Bass et al. | 340/721 X |
| 4,653,020 | 3/1987 | Cheselka et al. | 395/157 |
| 4,700,320 | 10/1987 | Kapur | 395/158 |
| 4,933,877 | 6/1990 | Hasebe | 395/158 |
| 5,001,469 | 3/1991 | Pappas et al. | 340/721 |
| 5,146,592 | 9/1992 | Pfeiffer et al. | 395/157 |
| 5,185,858 | 2/1993 | Emery et al. | 395/158 |

*Primary Examiner*—Raymond J. Bayerl

*Attorney, Agent, or Firm*—Limbach & Limbach; Alan S. Hodes

[57] ABSTRACT

An image display controller includes a first memory for storing data of an image to be displayed in a first window; a second memory for storing data of an image to be displayed in a second window, where no data is read from the second memory for image display during the data reading operation in the first memory; and a third memory for storing data of an overlay image on which the image of the first or second memory is superimposed, and also storing window data to set the range of the windows. The controller is arranged to prevent any disordered display of images and is capable of displaying an increased number of windows.

2 Claims, 6 Drawing Sheets

IMAGE DISPLAY CONTROLLER HAVING A COMMON MEMORY FOR STORAGE OF IMAGE OVERLAY DATA AND WINDOW IDENTIFICATION DATA

This is a continuation of application Ser. No. 07/778,013, filed Oct. 17, 1991 (now abandoned).

BACKGROUND OF THE INVENTION

1. Field of the Invention

The present invention relates to an image display controller adapted for use in a computer graphic apparatus or the like.

2. Description of the Prior Art

FIG. 3 is a block diagram showing an exemplary structure of a conventional image display controller capable of performing a multi-window display operation which superimposes a plurality of window images on a predetermined overlay image.

An overlay plane memory 1 serves to store overlay image data (basic data) forming the overlay on a screen, and RGB plane memories 5, 6 serve to store window image data. Meanwhile a window ID plane memory 4 is used for storing window identification data indicative of a window setting range.

For example, when images of five windows W1 through W5 are superimposed on one overlay image as illustrated in FIG. 4A, 4-bit basic data of the overlay image alone is written in the overlay plane memory 1 as shown in FIG. 4C. The overlay image includes, in addition to a rhombic pattern, some other display relative to command data required for control of an icon and so forth. Although the display relative to the command data may also be regarded as a window image, it is assumed here for the sake of descriptive convenience that any image written in the overlay plane memory 1 is defined as an overlay image, and any image written in the RGB plane memories 5, 6 is defined as a window image. Each window portion of the overlay plane memory 1 is rendered substantially blank so that the window image can be displayed there as it is.

The image data being presently displayed within the windows W1, W4, W5 as shown in FIG. 4D for example are stored in the RGB plane memory 5, and the image data to be displayed next are stored in the windows W2, W3. The image data being presently displayed within the windows W2, W3 as shown in FIG. 4E for example are stored in the RGB plane memory 6, and the image data to be displayed next are stored in the windows W1, W4, W5. Each of such image data regarding R (red), G (green) and B (blue) is composed of 8 bits.

Meanwhile in the window ID plane memory 4, as shown in FIG. 4B, 4-bit window ID 1 (0001) through (0101) are recorded in the areas of the windows W1 through W5 to signify that such are the areas of the windows W1 through W5. And in the overlay area, ID 0 (0000) is recorded to signify that the relevant area is not the one of any window.

The R, G, B outputs of the RGB plane memories 5 and 6 are supplied respectively to the contacts of switches 7R, 7G, 7B. And the output of the overlay plane memory 1 is supplied to a lookup table (LUT) 2, where the 4-bit basic data are converted into substantial R, G, B image data each composed of 8 bits. Thus the image data of the RGB plane memories 5 and 6 are composed of 24 bits (24 planes) and can be displayed in 16,700,000 ($=2^{24}$) colors, whereas the image data (basic data) of the overlay plane memory 1 is composed of 4 bits (4 planes) and is consequently displayed merely in 16 ($=2^4$) colors. The above arrangement is grounded on the reason that the overlay image generally does not require so many kinds of colors, and therefore the number of bits is reduced to diminish the memory capacity.

The R, G, B outputs of the LUT 2 are supplied respectively to the contacts of the switches 7R, 7G, 7B.

The switches 7 (7R, 7G, 7B) are selectively changed by the output of the LUT 3, so that either the overlay image data written in the overlay plane memory 1 or the window image data written in the RGB plane memory 5 or 6 is selected and outputted to be displayed on an unshown CRT or the like.

For controlling such selective change of the switches 7, the window identification data is read out from the window ID plane memory 4 and then is inputted to the LUT 3. As shown in FIG. 4B, the window identification data is so arranged as to correspond to the windows W1 through W5. And in response to the input identification data (0 in the embodiment) representing the overlay image (not any window), the switches 7 are changed in a manner to select the output of the LUT 2. On the other hand, in response to the input window identification data (1 through 5 in the embodiment) representing the windows W1 through W5, the switches 7 are so changed as to select the output of the RGB plane memory 5 or 6. Selection of either the RGB plane memory 5 or 6 is controlled through rewriting the content of the LUT 3 by the CPU 13. In this case, the switches 7 are changed in such a manner as to select the output of the RGB plane memory 5 in response to the window identification data of the windows W1, W4, W5, or to select the output of the RGB plane memory 6 in response to the window identification data of the windows W2, W3.

Thus, the window images illustrated in FIG. 4A are displayed in accordance with the outputs of the switches 7.

The read addresses in the overlay plane memory 1, the window ID plane memory 4 and the RGB plane memories 5, 6 are controlled by the output of a read address generator 8 inputted to each memory via an address bus.

Now a data writing operation will be described below.

The window identification data inputted via a data bus is written in the window ID plane memory 4, and the overlay image data inputted via the data bus is written in the overlay plane memory 1.

In the RGB plane memories 5, 6 are written the window image data inputted via the data bus, and such writing operation is controlled in the following manner.

In the RGB plane memory 5 for example, it is necessary to record only the image data of the windows W1, W4, W5 as illustrated in FIG. 4D. Therefore, the memory selector 11 is so actuated as to render the RGB plane memory 5 ready for writing the data under control of the CPU 13. The RGB plane memory 5 (as any of the RGB plane memory 6, overlay plane memory 1 and window ID plane memory 4) has a read-only port for display, and another port for enabling the CPU 13 to write or read the data therethrough, wherein the operations can be performed simultaneously in both ports.

When the image data for the window W1 is written, the ID generator 12 outputs window ID 1 to a comparator 10, which also receives the window identification data of FIG. 4B from the window ID plane memory 4.

The comparator 10 compares the two input data with each other per pixel and, upon coincidence of the two inputs, supplies a signal to the RGB plane memory 5 for recording the relevant pixel, whereby the image data is written in the area of the window W1 in the RGB plane memory 5.

When the image data for the window W4 or W5 is written, the ID generator 12 outputs window ID 4 or 5. Then such image data is recorded in the window 4 or 5.

The same procedure is executed in the case of writing the window image data in the RGB plane memory 6.

The write addresses in the memories 1, 4, 5, 6 are controlled by the output of a write address generator 9.

For displaying three-dimensional graphics as window images, there are further provided a Z buffer memory 14, a Z comparator 15, a Z value generator 16, a logic circuit 17 and a pattern generator 18.

In the Z buffer memory 14 for storing the depth data of display images, the greatest value is written first. For example, in case the Z buffer memory 14 has a 16-bit depth relative to each pixel, a value 65535 ($=2^{16}-1$) is set as the data for each pixel. The Z value generator 16 is controlled by the CPU 13 to generate the depth data (Z value) of the image to be written in the RGB plane memory 5 or 6. The depth data is so determined that the minimum Z value indicates the nearest image while the-maximum Z value indicates the farthest image. The Z comparator 15 compares the output of the Z buffer memory 14 with the output (Z value) of the Z value generator 16 per pixel, and when the Z value is smaller, the image data relevant thereto is written in the RGB plane memory 5 or 6 while such Z value is written at the relevant pixel position in the Z buffer memory 14. In case the Z value is equal to or greater than the output of the Z buffer memory 14, the image data relevant to such pixel is not written in the RGB plane memory 5 or 6. Also the Z value is not written either in the Z buffer memory 14.

If the data is overwritten in the RGB plane memory 5, 6 or the Z buffer memory 14, it follows that the new data is left therein. Accordingly, with repetition of the operation described above, the nearer image data (of the smaller Z value) is left in place of the farther image data (of the greater Z value), so that the image data of the greater depth is written in the RGB plane memory 5 or 6 and then is displayed.

The logic circuit 17 calculates the logic product (AND) of the output of the Z comparator 15 and that of the comparator 10, and supplies a write control signal to the RGB plane memory 5 or 6 in accordance with the result of such calculation. Therefore, three-dimensional graphics are drawn merely within the windows.

The pattern generator 18 is controlled by the CPU 13 and generates logic data 1 or 0 corresponding to a predetermined pattern. The logic circuit 17 further calculates the logic product (AND) of the pattern data, which is outputted from the pattern generator 18, and the output of the Z comparator 15, whereby three-dimensional graphics are drawn in the pattern-designated range within the window.

The calculation executed by the logic circuit 17 may be so modified that a variety of images are displayed by replacing a logic product (AND) with a logic sum (OR) or by properly combining predetermined outputs with each other.

As described above, in the conventional image display controller where the overlay plane memory 1 and the window ID plane memory 4 are independent of each other, there arises a problem of disordered display unless a timing coincidence is attained between the two memories in both the writing and reading operations. In addition, the number of windows displayable independently is limited by the number of window ID planes ($16(=2^4)$ in the above example) to consequently lower the efficiency of using the memories.

OBJECT AND SUMMARY OF THE INVENTION

It is an object of the present invention to provide an improved image display controller which is adapted to prevent any disordered display of images and is capable of displaying an increased number of windows.

According to one aspect of the present invention, there is provided an image display controller comprising a first memory for storing image data to be displayed in a first window; a second memory for storing image data to be displayed in a second window, where no data is read for display during the data reading operation in the first memory; and a third memory for storing data of an overlay image on which the image of the first or second memory is superimposed, and for also storing window data to set the range of the windows.

In such image display controller of the structure mentioned, both overlay image data and window identification data are stored in the third memory, so that no timing discrepancy is caused in writing or reading the data to consequently realize satisfactory display of an increased number of windows.

The above and other features and advantages of the present invention will become apparent from the following description which will be given with reference to the illustrative accompanying drawings.

DESCRIPTION OF THE PREFERRED EMBODIMENT

Figure 1:
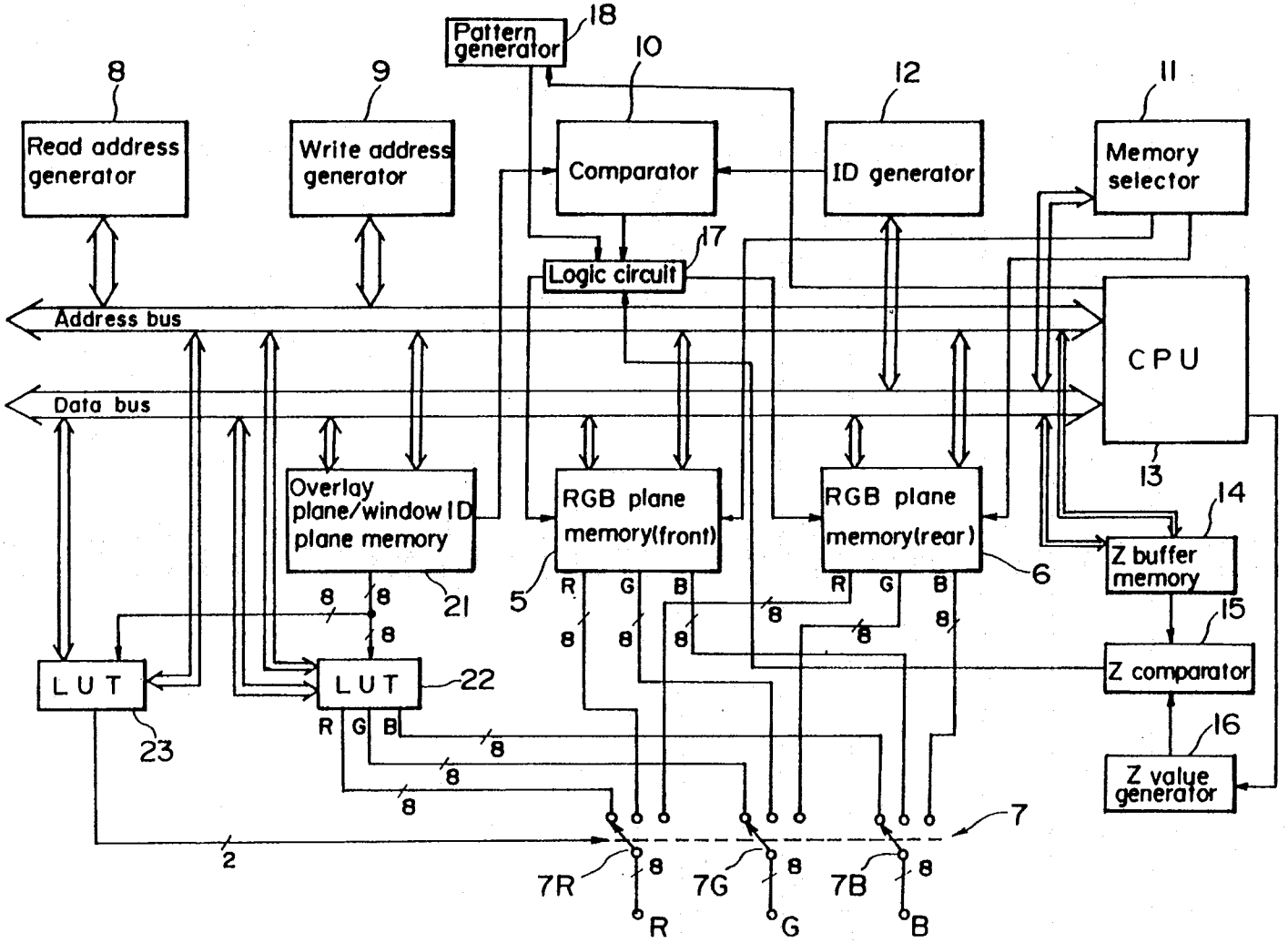
FIG. 1 is a block diagram of an image display controller embodying the present invention.
Figure 3:
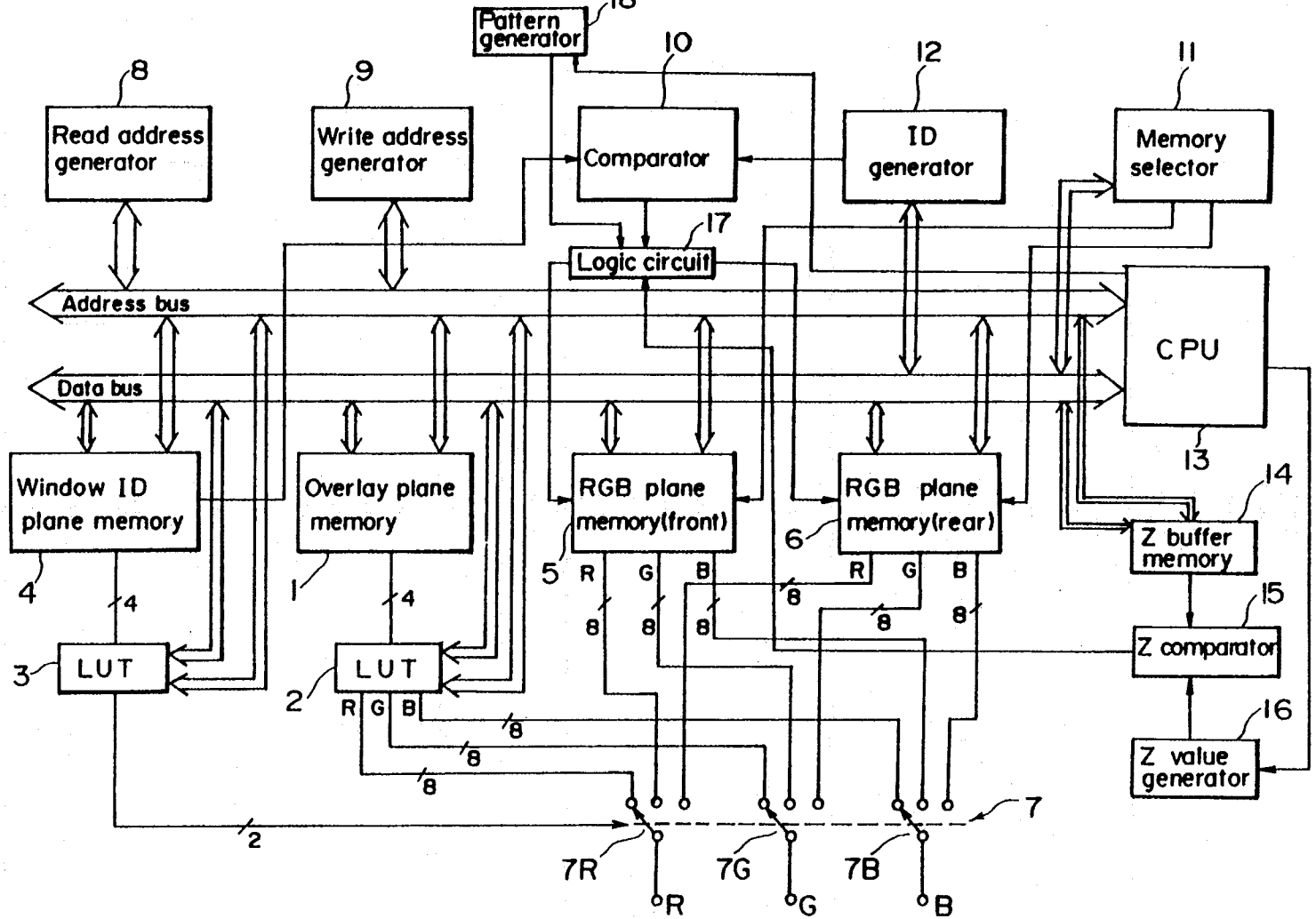
FIG. 3 (PRIOR ART)
FIG. 3 is a block diagram of a conventional image display controller.

FIG. 1 is a block diagram of an image display controller embodying the present invention, wherein any components corresponding to those used in FIG. 3 are denoted by the same reference numerals, and a repeated explanation thereof is omitted here.

In the embodiment of FIG. 1, an overlay plane/ window ID plane memory 21 is incorporated in place of the overlay plane memory 1 and the window ID plane memory 4 employed in the aforementioned conventional example of FIG. 3. In such overlay plane/window ID plane memory 21, there are stored data relative to an overlay image including an image of a command such as an icon, and window identification data indicating the range of windows. In the conventional controller of FIG. 3, the overlay plane memory 1 has a capacity of 4 planes (4 bits), and the window ID plane memory 4 also has a capacity of 4 planes (4 bits). Therefore, in an exemplary case where the total memory capacity remains the same as that in the aforementioned controller of FIG. 3, the overlay plane/window ID plane memory 21 is so formed as to have a capacity of 8 planes (8 bits). And the output of the overlay plane/window ID plane memory 21 is supplied to LUTs 22 and 23 which correspond respectively to the LUTs 2 and 3 in FIG. 3. The LUTs 22 and 23 are equivalent in fundamental function to the LUTs 2 and 3 respectively. More specifically, the LUT 22 detects the basic data of the overlay image out of the 8-bit data obtained from the overlay plane/window ID plane memory 21 and converts the detected data finally into R, G, B image data each composed of 8 bits. Meanwhile the LUT 23 detects the window identification data out of the 8-bit data obtained from the overlay plane/window ID plane memory 21 and converts the detected data into 2-bit switching data.

The same data is supplied from the overlay plane/-window ID plane memory 21 to both LUTs 22 and 23, where the input data is detected as the basic data of the overlay image and the window identification data respectively. Therefore the overlay image data and the window identification data written in the overlay plane/window ID plane memory 21 are rendered discriminable from each other.

The data written in the overlay plane/window ID plane memory 21 are different from the data written in the overlay plane memory 1 and the window ID plane memory 4 shown in FIG. 3, and the conversion tables written in the LUTs 22, 23 are also different from the conversion tables in the LUTs 2, 3.

The other systems of the embodiment shown in FIG. 1 are the same as that of the conventional example in FIG. 3.

Hereinafter the operation of the embodiment in FIG. 1 will be described in detail with reference to FIGS. 2A through 2D.

Figure 2A:
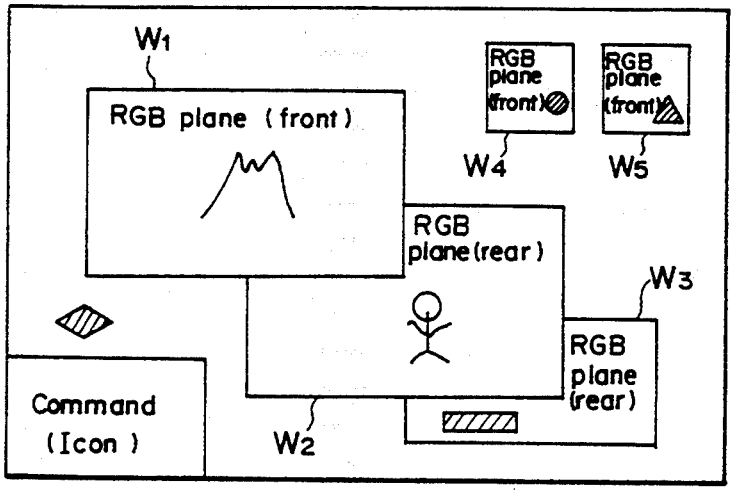
FIGS. 2A through 2D illustrate how images are displayed to explain the operation of the embodiment shown in FIG. 1.
Figure 4A:
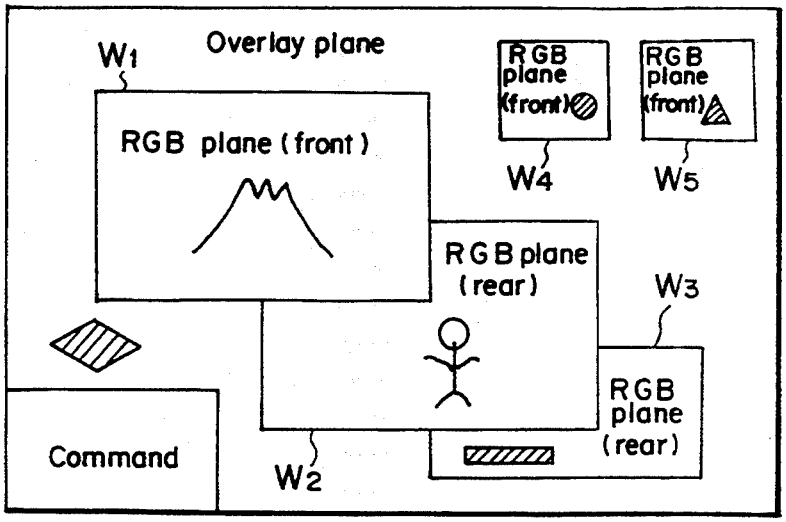
FIGS. 4A through 4E illustrate how images are displayed to explain the operation of the conventional controller shown in FIG. 3.
Figure 4B:
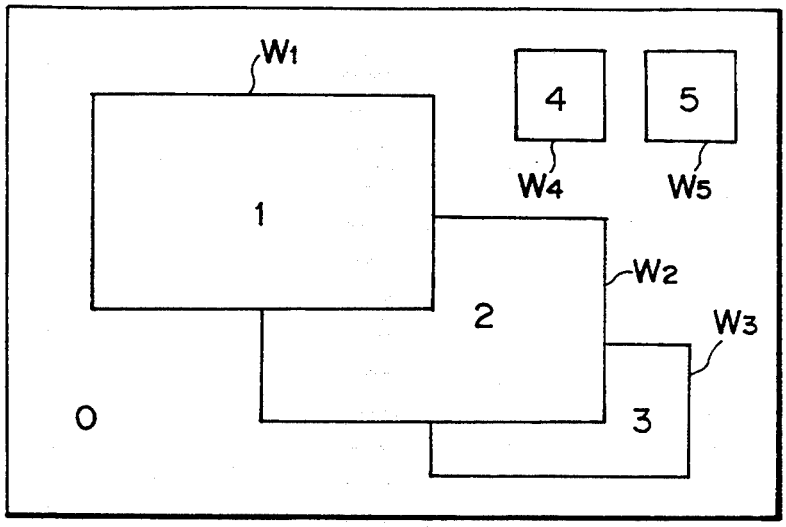
Figure 4C:
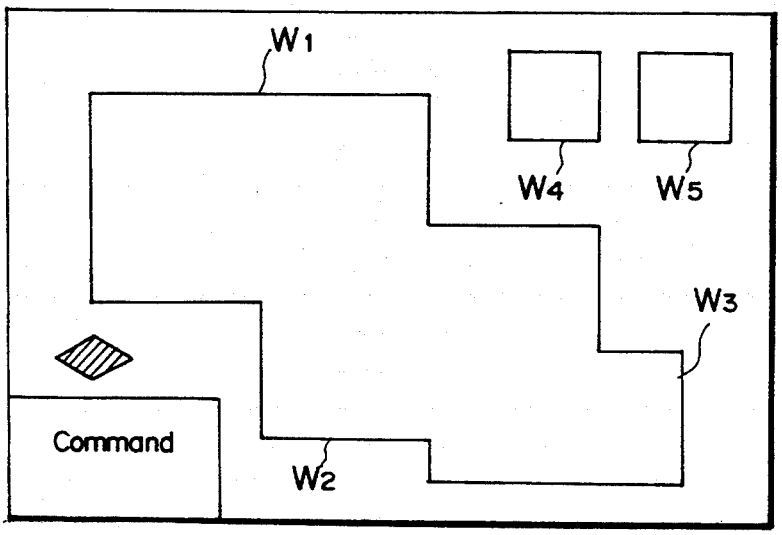
Figure 4D:
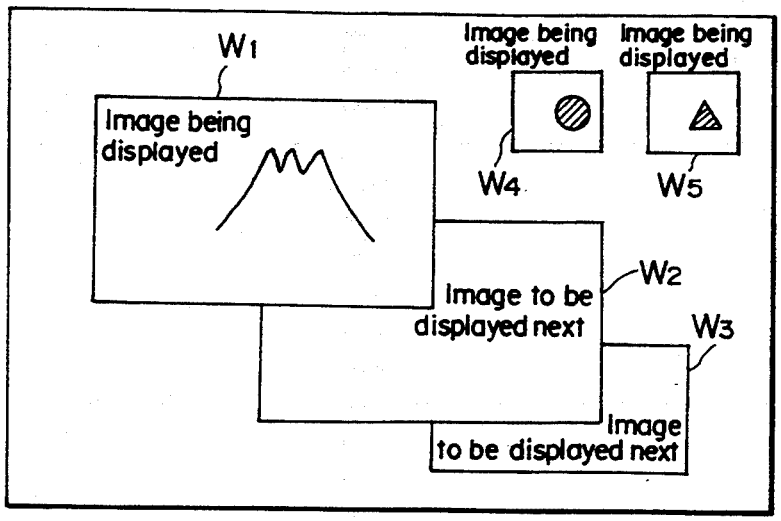
Figure 4E:
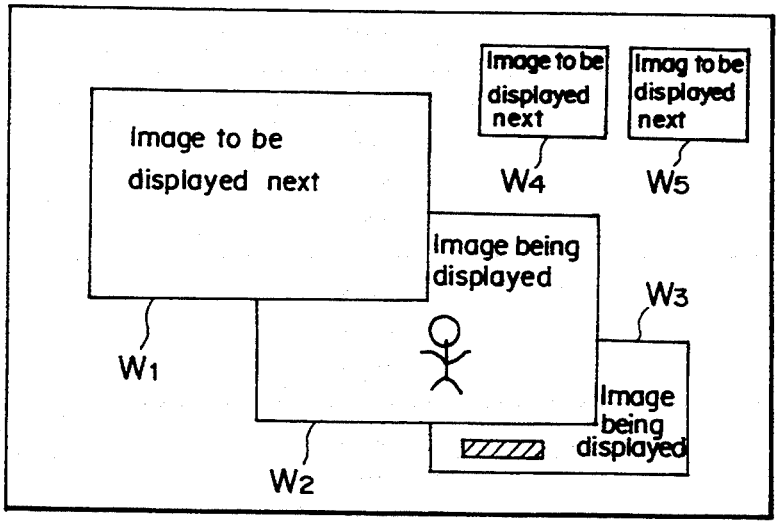

Suppose now that the images illustrated in FIG. 2A are outputted from the switches 7 and are displayed on an unshown CRT or the like. Similar to the foregoing case of FIG. 4A, the images include an overlay image data with a rhombic pattern and command data such as an icon, and five windows W1 through W5.

Figure 2B:
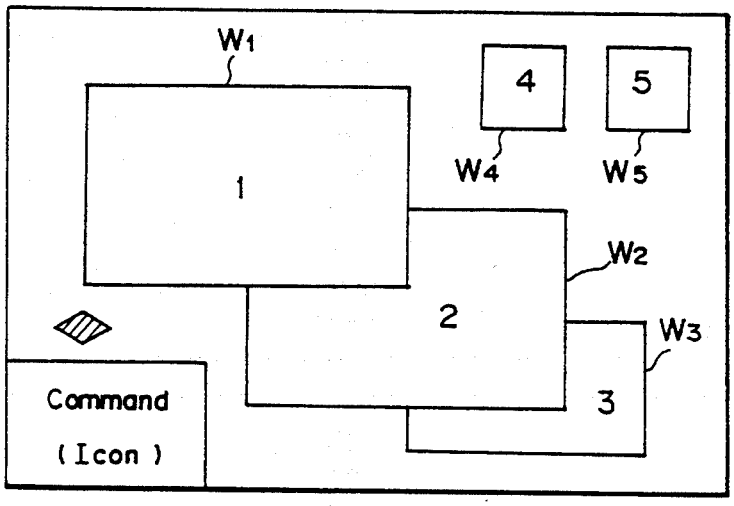
Figure 2C:
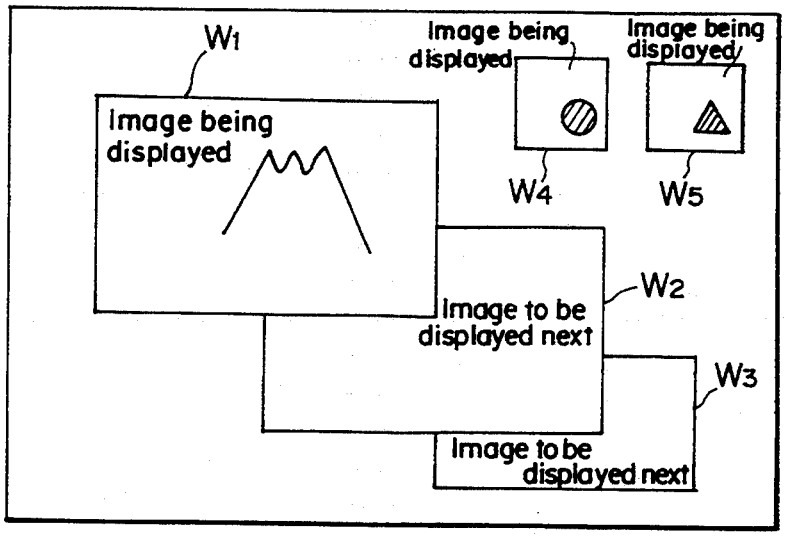
Figure 2D:
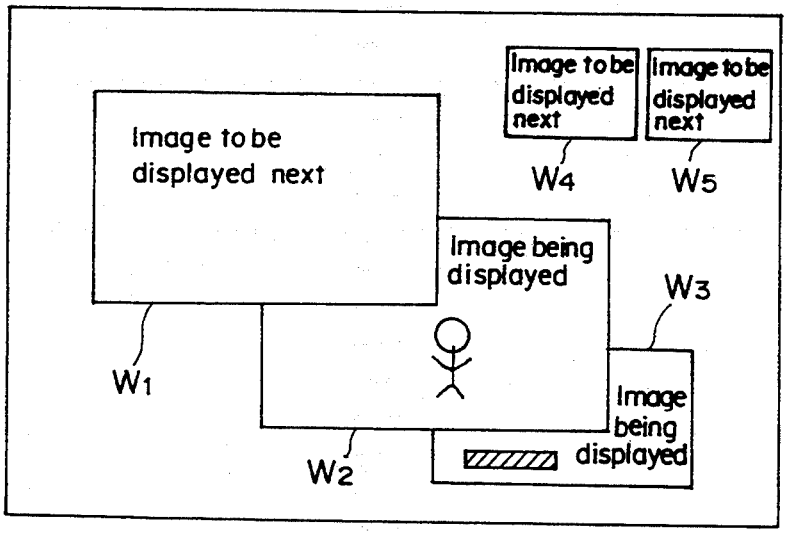

In the RGB plane memory 5 are written the image data for the windows W1, W4, W5 being presently displayed as illustrated in FIG. 2C. And in the RGB plane memory 6 are written the image data for the windows W2, W3 being displayed presently as illustrated in FIG. 2D. Meanwhile, image data to be displayed next are written in the windows W2, W3 of the RGB plane memory 5 and in the windows W1, W4, W5 of the RGB plane memory 6. FIGS. 2C and 2D illustrate mere examples, and any of the windows W1 through W5 may be written in either of the RGB plane memories 5 and 6.

In the overlay plane/window ID plane memory 21 are written the data illustrated in FIG. 2B. More specifically, window ID 1 through 5 identifying the individual windows are written at the positions of the windows W1 through W5, while the basic data of the overlay image are written at any positions other than the windows.

The LUT 22 detects the basic data of the overlay image out of the 8-bit data read from the overlay plane/window ID plane memory 21 and converts, with reference to the predetermined conversion table, the detected data into R, G, B overlay image data each composed of 8 bits. The R, G, B data outputted from the LUT 22 are supplied respectively to the contacts of the switches 7R, 7G, 7B. Meanwhile the R, G, B data each composed of 8 bits are supplied from the RGB plane memories 5, 6 to the other contacts of the switches 7R. 7G, 7B respectively. Therefore the R, G, B data of the overlay plane/window ID plane memory 21, the RGB plane memory 5 or the RGB plane memory 6 are selected and outputted by changing the switches 7R, 7G, 7B.

Meanwhile the LUT 23 detects the window identification data out of the 8-bit data obtained from the overlay plane/window ID plane memory 21. The 8-bit (256-kind) data are so prescribed in advance that some are used as window identification data while others are used as overlay image data (basic data). Upon detection of the window identification data out of the 8-bit data, the LUT 23 converts the detected data into 2-bit switching data with reference to the conversion table. And the switches 7 are selectively changed in conformity with such switching data.

In this case, upon detection of the window ID 1 (00000001), 4 (00000100) and 5 (00000101) for the windows W1, W4 and W5, the switches 7 are so changed as to select the output of the RGB plane memory 5. And upon detection of window ID 2 (00000010) and 3 (00000011), the switches 7 are so changed as to select the output of the RGB plane memory 6. Meanwhile, in response to no detection of any window identification data (i.e., upon detection of the overlay image data), the switches 7 are so changed as to select the output of the LUT 22.

In this manner, the overlay image data are read from the overlay plane/window ID plane memory 21, the image data for the windows W1, W4, W5 are read from the RGB plane memory 5, and the image data for the windows W2, W3 are read from the RGB plane memory 6 respectively, whereby the images are displayed as illustrated in FIG. 2A.

In changing the display contents of the windows W1, W4, W5, the new window image data to be displayed next are written in the windows W1, W4, W5 of the RGB plane memory 6. Also in changing the display contents of the windows W2, W3, the new window image data are written in the windows W2, W3 of the RGB plane memory 5. And under control of the CPU 13, the conversion table of the LUT 2-3 is so changed as to select the output of the RGB plane memory 6 in response to detection of the window identification data for the windows W1, W4, W5, or is so changed as to select the output of the RGB plane memory 5 in response to detection of the window identification data for the windows W2, W3, whereby the display contents of the individual windows are changed to the new images.

The read addresses of the overlay plane/window ID plane memory 21 and the RGB plane memories 5, 6 are set by the output of the read address generator 8.

The writing operation is fundamentally the same as that in the aforementioned controller of FIG. 3.

The write addresses in the overlay plane/window ID plane memory 21 and the RGB plane memories 5, 6 are designated by the output of the write address generator 9 supplied via the address bus, and the data inputted via the data bus are written in the designated addresses.

Upon designation of the window write address, the window identification data is inputted via the data bus to the overlay plane/window ID plane memory 21. Meanwhile, upon designation of the overlay write address, the overlay image data is inputted to the memory 21 via the data bus.

At the time of writing the data in the RGB plane memory 5 or 6, the window identification data to be written is outputted from the ID generator 12 to the comparator 10. Then the comparator 10 compares the data read from the overlay plane/window ID plane memory 21 with the data inputted from the ID generator 12. When the data read from the overlay plane/window ID plane memory 21 is the overlay image data or the window identification data relative to any window other than the desired one for writing the image data, the comparator 10 does not generate a coincidence output. Such coincidence output is generated only when the window identification data relative to the desired window is read out. In the RGB plane memory 5 or 6, there is stored the image data inputted via the data bus merely with regard to the pixel for which such coincidence output is supplied from the comparator 10, whereby the window image data is written in the desired window.

In case the window identification data outputted from the ID generator 12 remains the same until completion of writing in the desired window, the writing operation is performed for each window. However, if the window identification data generated are changed in accordance with requirements, it becomes possible to write the image data sequentially in different windows. And selective switching for such operation can be set per pixel.

Thus, due to the arrangement where the overlay plane/window ID plane memory has a storage capacity of 8 bits, it is possible to control a maximum of $256(=2^8)$ different windows. Consequently, a remarkable contrast is achieved in comparison with the conventional controller where the window ID plane memory has a 4-bit storage capacity and only a maximum of 16 different windows are controllable.

Since the operation for displaying three-dimensional graphics is the same as that in the aforementioned example of FIG. 3, a repeated explanation thereof is omitted here.

As described hereinabove, according to the image display controller of the present invention where both overlay image data and window identification data are written in the third memory, the efficiency of using the memories is enhanced. And control of writing the data in the first and second memories can be executed by processing merely the data in the third memory to thereby simplify the software for display control. Furthermore, there never occurs any timing discrepancy in reading or writing the overlay image data and the window identification data to eventually prevent disordered display of the images.

What is claimed is:

1. An image display controller for controlling a display device, comprising:

a first memory for storing image data of at least a first image to be displayed in a first window on the display device;

a second memory for storing image data of at least a second image to be displayed in a second window on the display device;

a third memory for storing data which includes basic data of an overlay image, said overlay image to be displayed with said first and second images superimposed thereupon, said data stored in said third memory further including window identification data to set the range of the windows;

first detecting means for obtaining data from said third memory, for detecting said basic data of an overlay image within said data obtained from said third memory, and for generating therefrom image data for display of the overlay image on the display device; and second detecting means for detecting, from the same data obtained from said third memory by the first detecting means, window identification data, and for generating therefrom switching data which indicates from which one of the first memory, the second memory and the first means for detecting image data is to be selected for display.

2. A method of controlling display of an image on a display device, comprising the steps of:

storing, in a first memory, data of a first image to be displayed in a first window on the display device;

storing, in a second memory, image data of a second image to be displayed in a second window on the display device;

storing, within a third memory, basic data of an overlay image, said overlay image to be displayed with said first and second images superimposed thereupon, and storing, within the third memory, window identification data to set the range of the windows;

obtaining data from said third memory;

detecting, within said data obtained from said third memory, the basic data of an overlay image and generating therefrom image data for display of the overlay image on the display device; and detecting, within the same data obtained from said third memory, window identification data and generating therefrom switching data which indicates which of the image data from the first memory, the image data from the second memory, and the image data generated from the basic data of an overlay image detected from the data obtained from said third memory is to be selected for display on the display device.

* * * * *